US009046834B2

(12) United States Patent
Egi

(10) Patent No.: US 9,046,834 B2
(45) Date of Patent: Jun. 2, 2015

(54) FIXING DEVICE AND IMAGE FORMING APPARATUS

(71) Applicant: KYOCERA DOCUMNET SOLUTIONS INC., Osaka-shi, Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/189,959

(22) Filed: Feb. 25, 2014

(65) Prior Publication Data

US 2014/0241768 A1 Aug. 28, 2014

(30) Foreign Application Priority Data

Feb. 28, 2013 (JP) ..... 2013-039714

(51) Int. Cl.
*G03G 15/20* (2006.01)

(52) U.S. Cl.
CPC ..... *G03G 15/2017* (2013.01); *G03G 15/2053* (2013.01); *G03G 2215/2035* (2013.01)

(58) Field of Classification Search
CPC ..... G03G 15/2017; G03G 15/2064; G03G 15/2089
USPC ..... 399/329
See application file for complete search history.

(56) References Cited

U.S. PATENT DOCUMENTS

2013/0336691 A1* 12/2013 Gon et al. ..... 399/329

FOREIGN PATENT DOCUMENTS

JP 2005134763 A * 5/2005
JP 2005-249958 A 9/2005
JP 2006047768 A * 2/2006

OTHER PUBLICATIONS

Naito (JP 2006-047768 A), Feb. 2006, JPO Computer Translation.*

* cited by examiner

*Primary Examiner* — Erika J Villaluna
(74) *Attorney, Agent, or Firm* — Studebaker & Brackett PC

(57) ABSTRACT

A fixing device includes a fixing belt, a pressuring rotator, a pressing member, a holding member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The holding member holds the pressing member. The end cap is mounted to an end part in a direction of a rotation axis of the fixing belt, and is movable in a radial direction of the fixing belt with respect to the holding member.

14 Claims, 11 Drawing Sheets

FIXING DEVICE AND IMAGE FORMING APPARATUS

INCORPORATION BY REFERENCE

This application is based on and claims the benefit of priority from Japanese Patent application No. 2013-039714 filed on Feb. 28, 2013, the entire contents of which are incorporated herein by reference.

BACKGROUND

The present disclosure relates to a fixing device configured to fix a toner image on a recording medium and an image forming apparatus provided with the fixing device.

An electrographic image forming apparatus such as a printer or a copying machine forms a toner image on a surface of a recording medium such as a sheet, and subsequently, heats and pressures the recording medium and the toner image by a fixing device, thereby fixing the toner image on the recording medium.

As a manner of the above-mentioned fixing device, a manner of forming a fixing nip for heating and pressuring a recording medium and a toner image by a fixing roller and a pressuring roller is known. The above-mentioned fixing roller is formed by covering an outer circumferential face of a metallic cored bar with a resin having a high toner release property, for example. Also, as a heat source for heating the above-mentioned fixing roller, a halogen heater is used, for example. This halogen heater is disposed inside of the cored bar of the fixing roller, for example.

On the other hand, a manner (so called IH (Induction Heating) manner) of using an IH coil as a heat source instead of the halogen heater is known. The above-mentioned IH coil generates a magnetic field by way of electrification. Among fixing devices of such IH manner, there exists a fixing device forming the fixing nip by a fixing belt and a pressuring roller instead of forming the fixing nip by a fixing roller and a pressuring roller. The above-mentioned fixing belt is composed of a rotatable endless belt. In addition, an eddy current is generated at the fixing belt byway of action of the magnetic field generated by the IH coil.

Also, as a rotation manner of the fixing belt, a manner of rotating the fixing belt together with one or a plurality of rollers disposed inside of the fixing belt is known. On the other hand, a manner of disposing a pressing member inside of the fixing belt and sliding the fixing belt with respect to the pressing member is known as well.

In the fixing device of such a manner, the fixing belt is prone to deviate to the outside in the direction of a rotation axis of the fixing belt, and one of the important problems is to restrain such deviation of the fixing belt. For example, an end cap is mounted to an end part in the direction of the rotation axis of the fixing belt (hereinafter, simply referred to as an "end part of the fixing belt"), and by the end cap, deviation of a predetermined margin or more of the fixing belt is restrained. In a case where the deviation of the fixing belt is thus restrained by using the end cap, it is desirable to rotate the end cap together with the fixing belt in order to prevent lowering of durability of an end part of the fixing belt. In addition, in order to thus rotate the end cap together with the fixing belt, the end part of the fixing belt may be corrected in a circular shape by the end cap.

A problem in a case where the end part of the fixing belt is corrected in the circular shape by the end cap as mentioned above will be described with reference to FIG. 11.

In a fixing nip 71, a fixing belt 72 comes into pressure contact with a pressuring roller 73, and is pressed by a pressing member (not shown). Thus, the fixing belt 72 is deformed, and a sectional shape of the fixing belt 72 is formed in a shape of an inaccurate circle. In contrast to this, at an end part of the fixing belt 72, a sectional shape of the fixing belt 72 is corrected in a shape of an accurate circle by an end cap 74. Thus, the fixing belt 72 is significantly displaced in a peripheral region of the end part of the fixing nip 71 (refer to the portion Y1 of FIG. 11) and in a peripheral region of the end part of the fixing belt 72 (refer to the portion Y2 of FIG. 11), a stress concentrates on this displaced portion, and there is a concern about damage of the fixing belt 72. In order to eliminate such concern, a distance from the end part of the fixing nip 71 to the end part of the fixing belt 72 is occasionally taken to be sufficiently long (refer to an arrow d of FIG. 11). As a result, a length in a direction of a rotation axis of the fixing belt 72 increases, causing upsizing of a fixing device and eventually leading to upsizing of an image forming apparatus as well.

SUMMARY

In accordance with an embodiment of the present disclosure, a fixing device includes a fixing belt, a pressuring rotator, a pressing member, a holding member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The holding member holds the pressing member. The end cap is mounted to an end part in a direction of a rotation axis of the fixing belt, and is movable in a radial direction of the fixing belt with respect to the holding member.

In accordance with an embodiment of the present disclosure, an image forming apparatus includes a fixing device. The fixing device includes a fixing belt, a pressuring rotator, a pressing member, a holding member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The holding member holds the pressing member. The end cap is mounted to an end part in a direction of a rotation axis of the fixing belt, and is movable in a radial direction of the fixing belt with respect to the holding member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
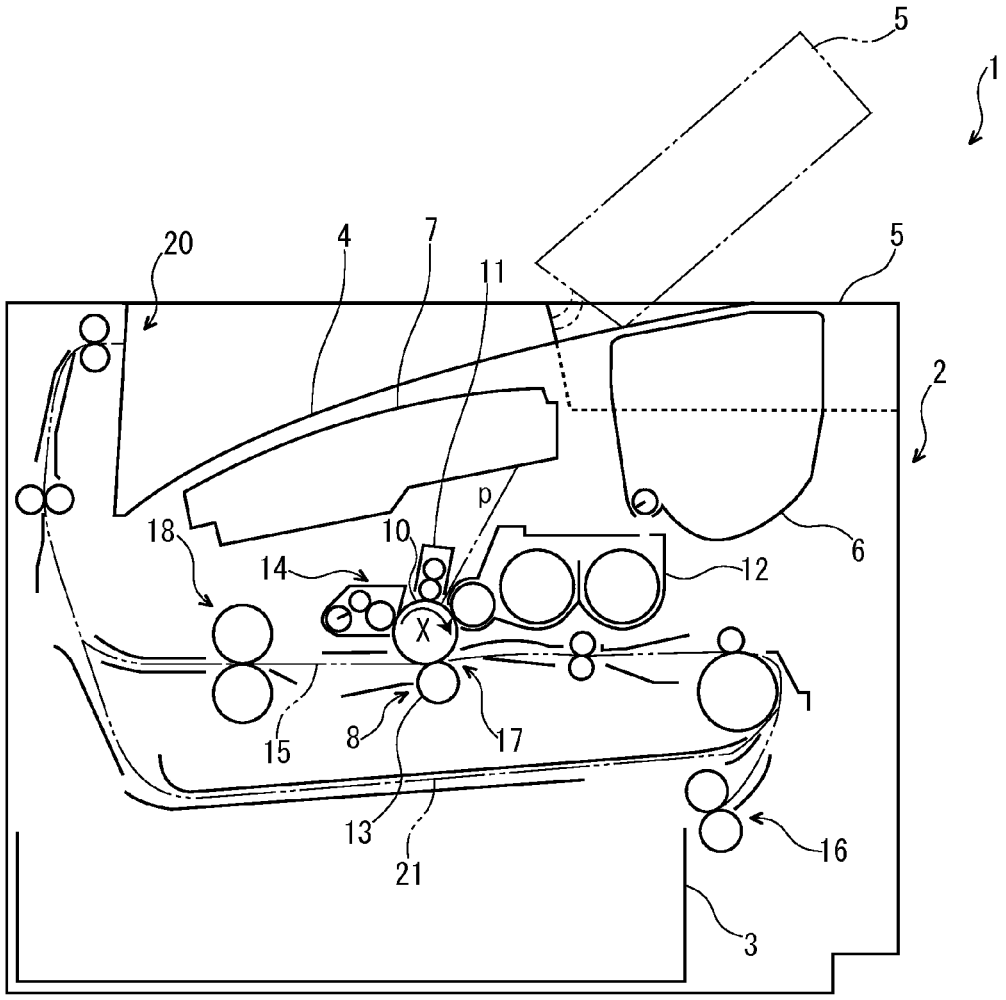
FIG. 1 is a schematic view showing an outline of a configuration of a printer according to a first embodiment of the present disclosure.

First, with reference to FIG. 1, the entire structure of a printer 1 (an image forming apparatus) will be described. FIG. 1 is a schematic view showing an outline of a configuration of a printer according to a first embodiment of the present disclosure.

The printer 1 includes a box-formed printer main body 2. In a lower part of the printer main body 2, a sheet feeding cartridge 3 storing sheets (recording medium) is provided and, on an upper surface of the printer main body 2, a sheet ejecting tray 4 is provided. On the upper surface of the printer main body 2, an upper cover 5 is provided openably and closably near the sheet ejecting tray 4. Below the upper cover 5, a toner container 6 is stored.

In an upper part of the printer main body 2, an exposure device 7 consisting of a laser scanning unit (LSU) is arranged below the sheet ejecting tray 4. Below the exposure device 7, an image forming unit 8 is provided. In the image forming unit 8, a photosensitive drum 10 as an image carrier is rotatably provided. Around the photosensitive drum 10, a charger 11, a developing device 12, a transferring roller 13 and a cleaning device 14 are arranged along the rotational direction of the photosensitive drum 10 (refer to an arrow X in FIG. 1).

In the printer main body 2, a sheet conveying path 15 is provided. At an upper stream end of the conveying path 15, a sheet feeder 16 is provided. At an intermediate stream part of the conveying path 15, a transferring unit 17 formed by the photosensitive drum 10 and the transferring roller 13 is provided. At a lower stream part of the conveying path 15, a fixing device 18 is provided. At a lower stream end of the conveying path 15, a sheet ejecting part 20 is provided. Below the conveying path 15, an inversion path 21 for duplex printing is formed.

Next, the operation of forming an image by the printer 1 having the above-mentioned configuration will be described.

When the power is supplied to the printer 1, various parameters are initialized and initial determination, such as temperature determination of the fixing device 18, is carried out. Subsequently, when image data is inputted and a printing start is directed from a computer or the like connected with the printer 1, the image forming operation is carried out as follows.

First, the surface of the photosensitive drum 10 is electrically charged by the charger 11. Then, the surface of the photosensitive drum 10 is exposed corresponding to the image data with a laser (refer to a two-dot line P in FIG. 1) from the exposure device 7, thereby forming an electrostatic latent image on the surface of the photosensitive drum 10. The electrostatic latent image is developed to a toner image with the toner (developer) by the development device 12.

On the other hand, a sheet fed from the sheet feeding cartridge 3 by the sheet feeder 16 is conveyed to the transferring unit 17 in a suitable timing for the above-mentioned image forming operation. Then, in the transferring unit 17, the toner image on the photosensitive drum 10 is transferred onto the sheet. The sheet with the transferred toner image is conveyed to a lower stream side on the conveying path 15 to enter the fixing device 18, and then, the toner image is fixed on the sheet in the fixing device 18. The sheet with the fixed toner image is ejected from the sheet ejecting part 20 on the sheet ejecting tray 4. The toner remained on the photosensitive drum 10 is collected by the cleaning device 14.

Next, a fixing device 18 will be described with reference to FIG. 2 and FIG. 3.

Hereinafter, for the sake of convenience of explanation, the left side of the sheet in FIG. 2 (the frontal side of the sheet in FIG. 3) corresponds to a front side (foreside) of the fixing device 18. Also, an arrow I of FIG. 2 indicates inside in a forward or backward direction, and an arrow O of FIG. 2 indicates outside in the forward or backward direction.

Figure 2:
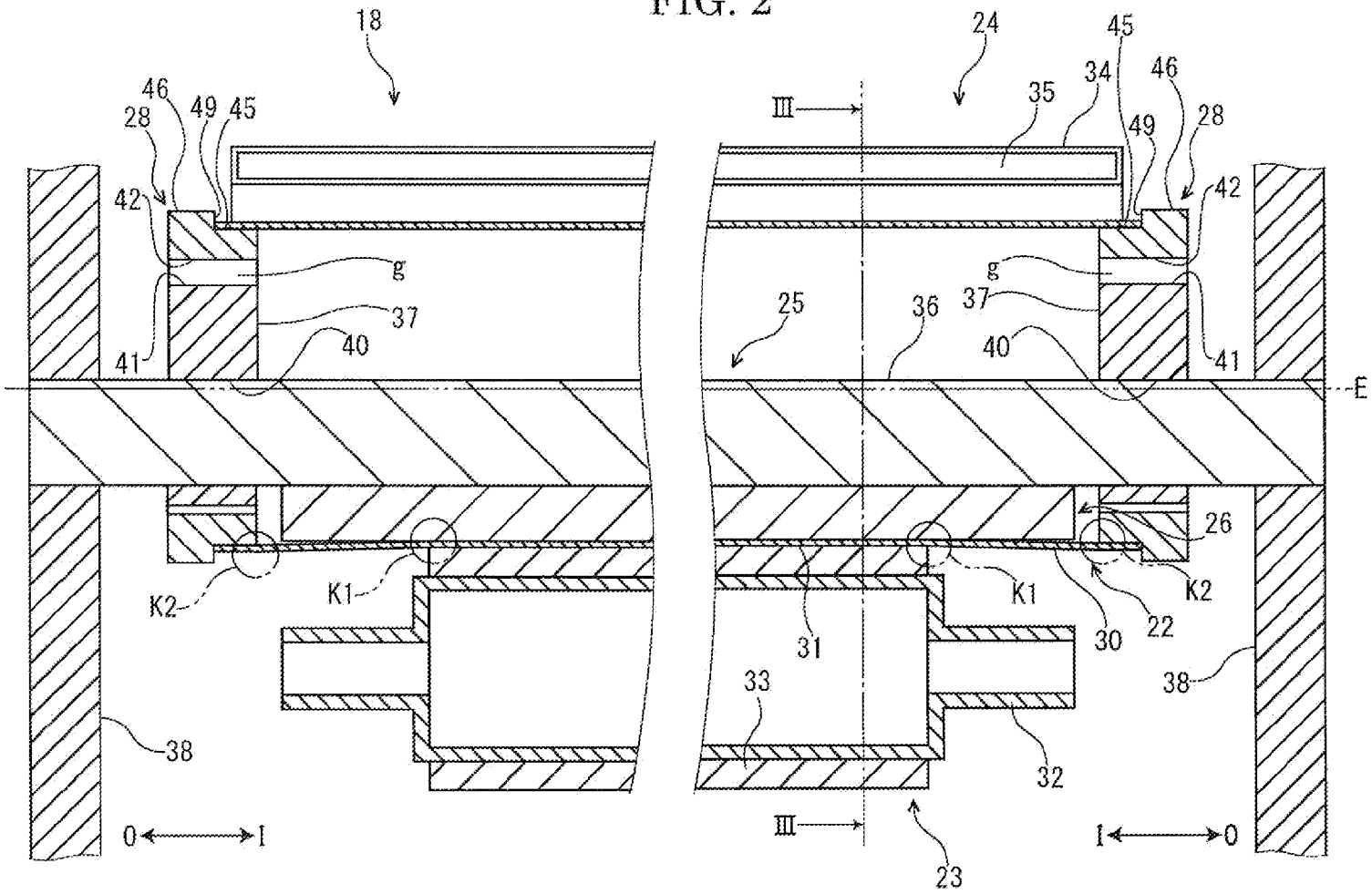
FIG. 2 is a sectional side view showing a fixing device in the printer according to the first embodiment of the present disclosure.
Figure 3:
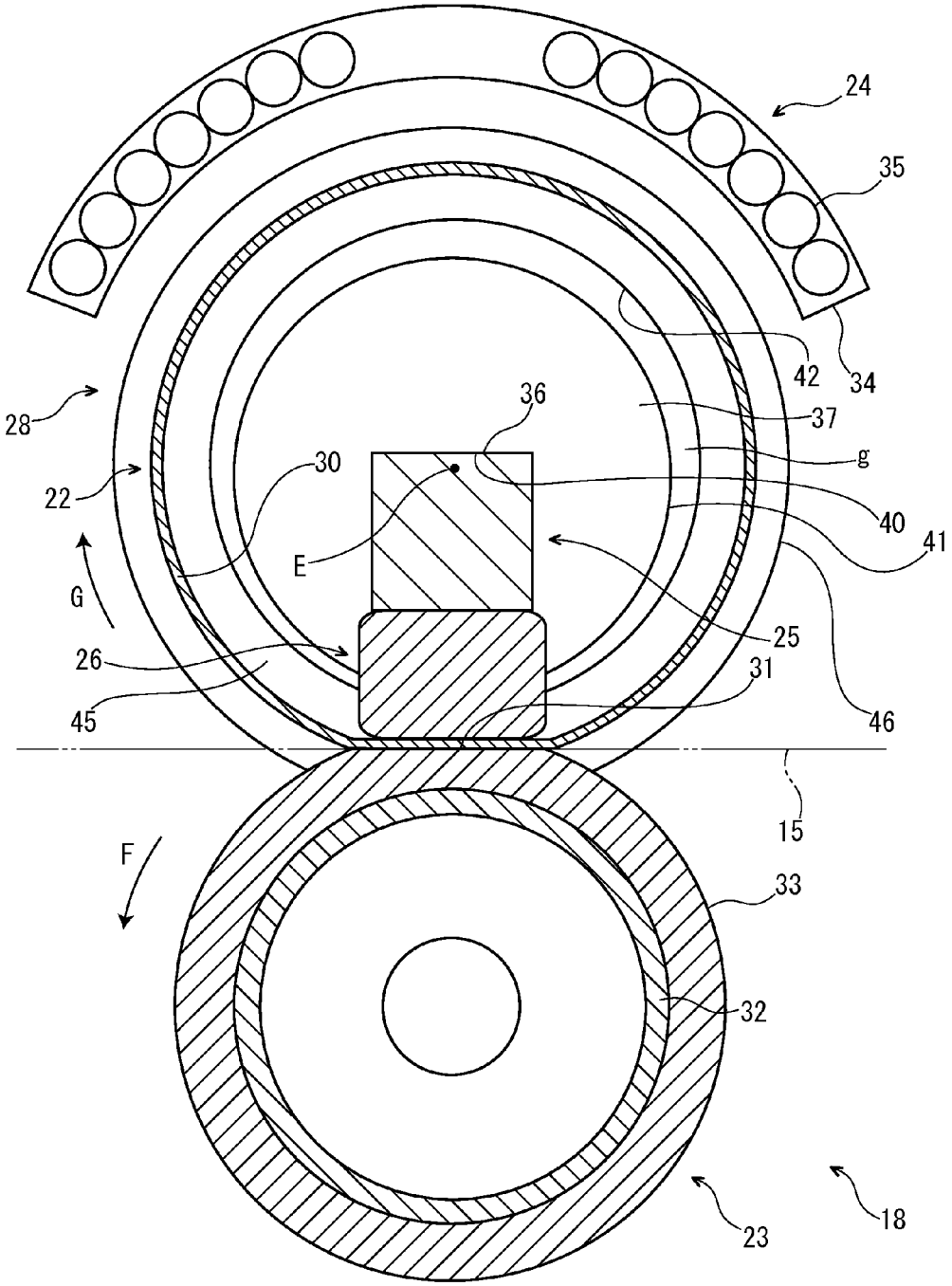
FIG. 3 is a sectional view along the line III-III of FIG. 2.

As shown in FIG. 2 and FIG. 3, the fixing device 18 includes a fixing belt 22, a pressuring roller 23 (pressuring rotator) disposed downward of the fixing belt 22, an IH fixing unit 24 disposed upward of the fixing belt 22, a holding member 25 disposed inside of the fixing belt 22, a pressing pad 26 (pressing member) disposed downward of the holding member 25, and end caps 28 respectively disposed at both end sides in the forward or backward direction of the fixing belt 22.

First, the fixing belt 22 will be described. The fixing belt 22 is an endless thin belt having flexibility, and forms an elongated cylindrical shape in the forward or backward direction. The fixing belt 22 is rotatable around a rotation axis E extending in the forward or backward direction. Namely, in the embodiment, the forward or backward direction is a direction of the rotation axis of the fixing belt 22.

The fixing belt 22 is composed of a substrate layer 30 and a release layer (not shown) covering the substrate layer 30, for example. The substrate layer 30 of the fixing belt 22 is made of a metal such as nickel or stainless or a resin such as PI (Polyimide), for example. The release layer of the fixing belt 22 is made of a fluorine-based resin such as PFA, for example. The fixing belt 22 may include an elastic layer between the substrate layer 30 and the release layer. This elastic layer is made of a silicone rubber, for example.

Next, the pressuring roller 23 will be described. The pressuring roller 23 forms an elongated cylindrical shape in the forward or backward direction. The pressuring roller 23 comes into pressure contact with the fixing belt 22, and a fixing nip 31 is formed between the fixing belt 22 and the pressuring roller 23. When a sheet passes through the fixing nip 31, the sheet and the toner image are heated and pressured, and the toner image is fixed to the sheet.

The pressuring roller 23 is rotatably supported by a fixing frame (not shown). The pressuring roller 23 is connected to a drive source (not shown), and when the pressuring roller 23 is rotated by the drive source, the fixing belt 22 rotates in the opposite direction to the pressuring roller 23 accompanying with the rotation of the pressuring roller 23. The pressuring roller 23 is configured to convey the sheet to a downstream side of the conveying path 15 in cooperation with the fixing belt 22.

The pressuring roller 23 is composed of a cylindrical cored bar 32, an elastic layer 33 provided around the cored bar 32, and a release layer (not shown) covering the elastic layer 33, for example. The cored bar 32 of the pressuring roller 23 is made of a metal such as stainless or aluminum, for example.

The elastic layer 33 of the pressuring roller 23 is made of a silicone rubber or a silicone sponge, for example. The release layer of the pressuring roller 23 is made of a fluorine-based resin such as PFA, for example.

Next, the IH fixing unit 24 will be described. The IH fixing unit 24 includes a casing member 34 and an IH coil 35 (heat source) housed in the casing member 34. The IH coil 35 is disposed outside of the fixing belt 22, and is provided in an arc shape along an outer circumference of the fixing belt 22. The IH coil 35 is configured to generate a magnetic field when a high-frequency current is fed to the IH coil 35.

Next, the holding member 25 will be described. The holding member 25 includes a main body part 36 and insertion parts 37 fixed to both side parts in the forward or backward direction of the main body part 36.

The main body part 36 extends in a forward or backward direction, and has a rectangular sectional shape. The main body part 36 passes through a lower part of the fixing belt 22. Both end parts in the forward or backward direction of the main body part 36 are fixed to locking members 38 (refer to FIG. 2) respectively disposed forward and backward of the fixing belt 22. The locking member 38 is fixed to a fixing frame (not shown) or forms a part of the fixing frame, for example.

Each insertion part 37 has an engaging hole 40 having a rectangular sectional shape. The engaging hole 40 engages with an outer circumference of the main body part 36, and each insertion part 37 is thereby fixed to the outer circumference of the main body part 36. An outer circumferential face 41 of each insertion part 37 forms a shape of an accurate circle.

Next, the pressing pad 26 will be described. The pressing pad 26 extends in a forward or backward direction, and has a substantially rectangular sectional shape. The pressing pad 26 is housed in a lower end part of the fixing belt 22. A top face of the pressing pad 26 is fixed to a bottom face of the holding member 25. In this manner, the pressing pad 26 is held by the holding member 25. A lower end part of the pressing pad 26 comes into contact with an inner circumferential face of the fixing belt 22, and presses the fixing belt 22 from inside toward the pressuring roller 23. As the fixing belt 22 rotates, the fixing belt 22 slides with respect to the pressing pad 26. The pressing pad 26 comes into contact with only a lower part (a part of the fixing nip 31 side) of an inner circumferential face of the fixing belt 22.

Next, the end caps 28 will be described. Each end cap 28 forms a cylindrical shape. In each end cap 28, an accurate circle-shaped through hole 42 is formed along a forward or backward direction, and the main body part 36 of the holding member 25 passes through this through hole 42. The insertion part 37 of the holding member 25 is inserted into the through hole 42. A gap g is provided between the outer circumferential face 41 of the insertion part 37 and the through hole 42 of each end cap 28. Thus, each end cap 28 is movable in a radial direction of the fixing belt 22 (for example, in a vertical direction or in a lateral direction) with respect to the holding member 25.

Each end cap 28 includes a fixed part 45 and an engagingly locking part 46 provided outside in a forward or backward direction of the fixed part 45. Since an outer diameter of the fixed part 45 is smaller than an outer diameter of the engagingly locking part 46, a boundary part 49 between the fixed part 45 and the engagingly locking part 46 forms a stepped shape. An outer circumferential face of the fixed part 45 is fixed to both end parts in the forward or backward direction of an inner circumferential face of the fixing belt 22. In this manner, each end cap 28 is mounted to both end parts in the forward or backward direction of the fixing belt 22. The fixed part 45 corrects each end part in the forward or backward direction (opening part) of the fixing belt 22 in a circular shape. The engagingly locking part 46 engagingly locks each end part in the forward or backward direction of the fixing belt 22.

In the constituent elements as described above, when the toner image is fixed to a sheet, the pressuring roller 23 is rotated by a drive source (not shown) (refer to an arrow F of FIG. 3). When the pressuring roller 23 is thus rotated, the fixing belt 22 brought into pressure contact with the pressuring roller 23 rotates in an opposite direction to the pressuring roller 23 (refer to an arrow G of FIG. 3). Accompanying with this, each end cap 28 mounted to each end part in the forward or backward direction of the fixing belt 22 rotates together with the fixing belt 22. Even if the pressuring roller 23, the fixing belt 22, and each end cap 28 rotate, the IH fixing unit 24, the holding member 25, and the pressing pad 26 hold an inactive state.

When the toner image is fixed to the sheet, a high-frequency current is fed to the IH coil 35. Accompanying with this, the IH coil 35 generates a magnetic field, and by way of action of this magnetic field, an eddy current is generated at the fixing belt 22, and then, the fixing belt 22 develops heat. In this state, when the sheet passes through the fixing nip 31, the sheet and the toner image are heated and pressured, and then, the toner image is fixed to the sheet.

Figure 4:
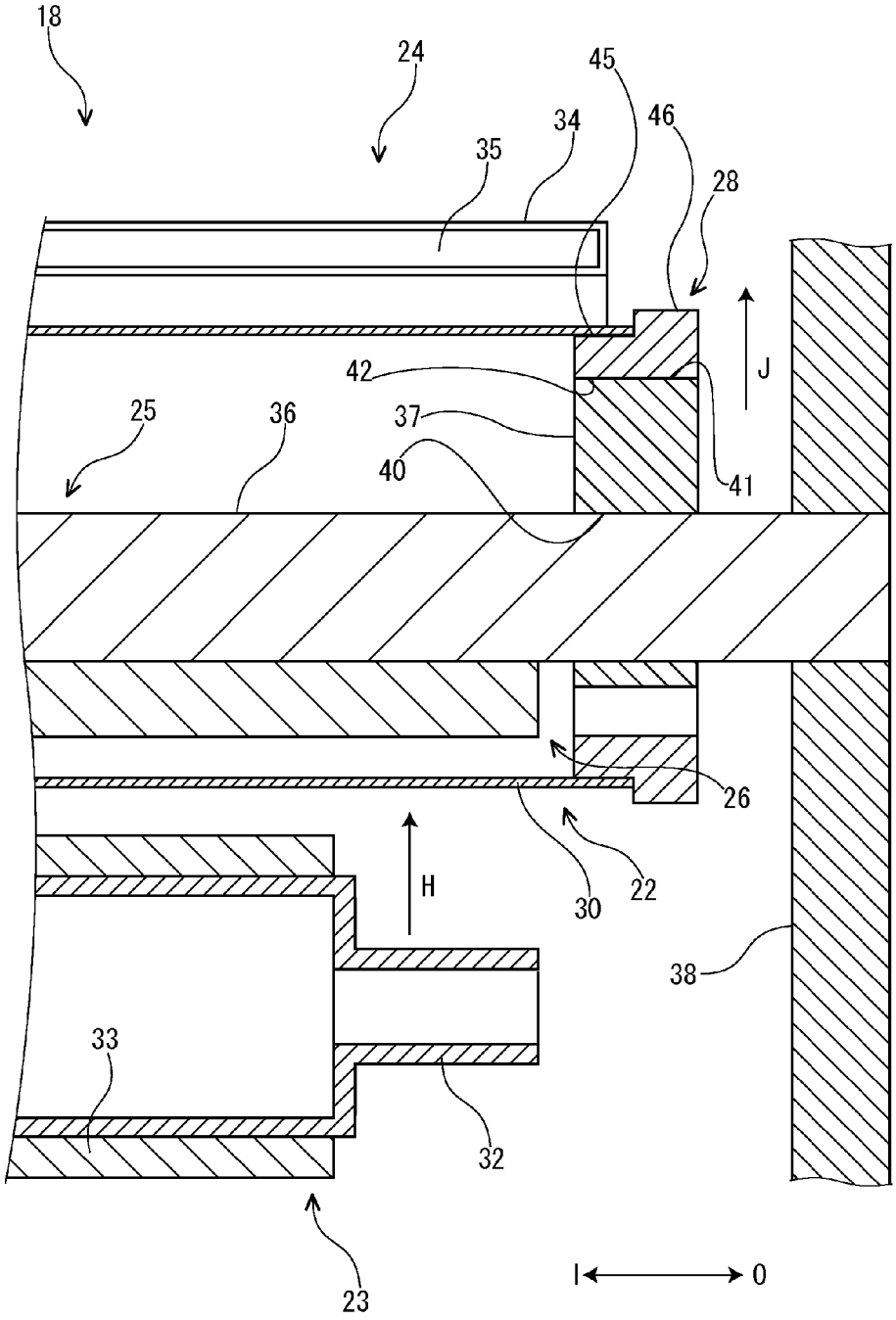
FIG. 4 is a sectional side view showing a condition that a pressure contact between the pressuring roller and the fixing belt is released in the fixing device of the printer according to the first embodiment of the present disclosure.

In the constituent elements as mentioned above, a state of releasing a pressure contact between the pressuring roller 23 and the fixing belt 22 is shown in FIG. 4. From this state, in a case where the pressuring roller 23 comes into pressure contact with the fixing belt 22, the pressuring roller 23 presses the fixing belt 22 upward, and the fixing belt 22 moves upward (in a radial direction of the fixing belt 22), as indicated by an allow H of FIG. 4. Accompanying with this, as indicated by an arrow J in FIG. 4, each end cap 28 mounted to each end part in the forward or backward direction of the fixing belt 22 moves upward (in the radial direction of the fixing belt 22) together with the fixing belt 22.

In the embodiment, as described above, the end cap 28 is movable in the radial direction of the fixing belt 22 with respect to the holding member 25. In other words, a relative position to the holding member 25 of the end cap 28 has a degree of freedom. Thus, it is possible to move each end cap 28 in the radial direction of the fixing belt 22 together with the fixing belt 22. Accompanying with this, it is possible to avoid significant displacement of the fixing belt 22 in a peripheral region of end parts of the fixing nip 31 (refer to the portion K1 of FIG. 2) or in a peripheral region of end parts of the fixing belt 22 (refer to the portion K2 of FIG. 2). Accompanying with this, a stress applied to the fixing belt 22 can be dispersed, and damage of the fixing belt 22 can be prevented.

In addition, each end cap 28 is configured to be movable to the holding member 25 in the radial direction of the fixing belt 22 to thereby avoid displacement of the fixing belt 22. Thus, there is no need to increase a distance from an end part of the fixing nip 31 to an end part of the fixing belt 22 in order to avoid displacement of the fixing belt 22. Thus, the distance from the end part of the fixing nip 31 to the end of the fixing belt 22 can be shortened, and accompanying with this, downsizing of the fixing device 18 can be achieved.

Further, both end parts in the forward or backward direction of the fixing belt 22 are corrected in a circular shape by the end caps 28, and the end caps 28 rotate together with the fixing belt 22. Thus, it is possible to prevent an occurrence of crack or breakage at each end part in the forward or backward direction of the fixing belt 22 due to a friction with the end cap 28, and durability of the fixing belt 22 can be improved.

Moreover, a gap g is provided between the insertion part 37 of the holding member 25 and the end cap 28. By adopting such configuration, the number of parts can be reduced, and a configuration of the fixing device 18 can be simplified.

Furthermore, the holding member 25 includes insertion parts 37 fixed to an outer circumference of the main body part 36, and each insertion part 37 is inserted into the through hole 42 of each end cap 28. Thus, a position of the fixing belt 22 can be stabilized.

Further, since the IH coil 35 is used as the heat source, it is possible to improve efficiency and velocity of heating the fixing belt 22 in comparison with a case of using a halogen heater or the like as a heat source.

Figure 5:
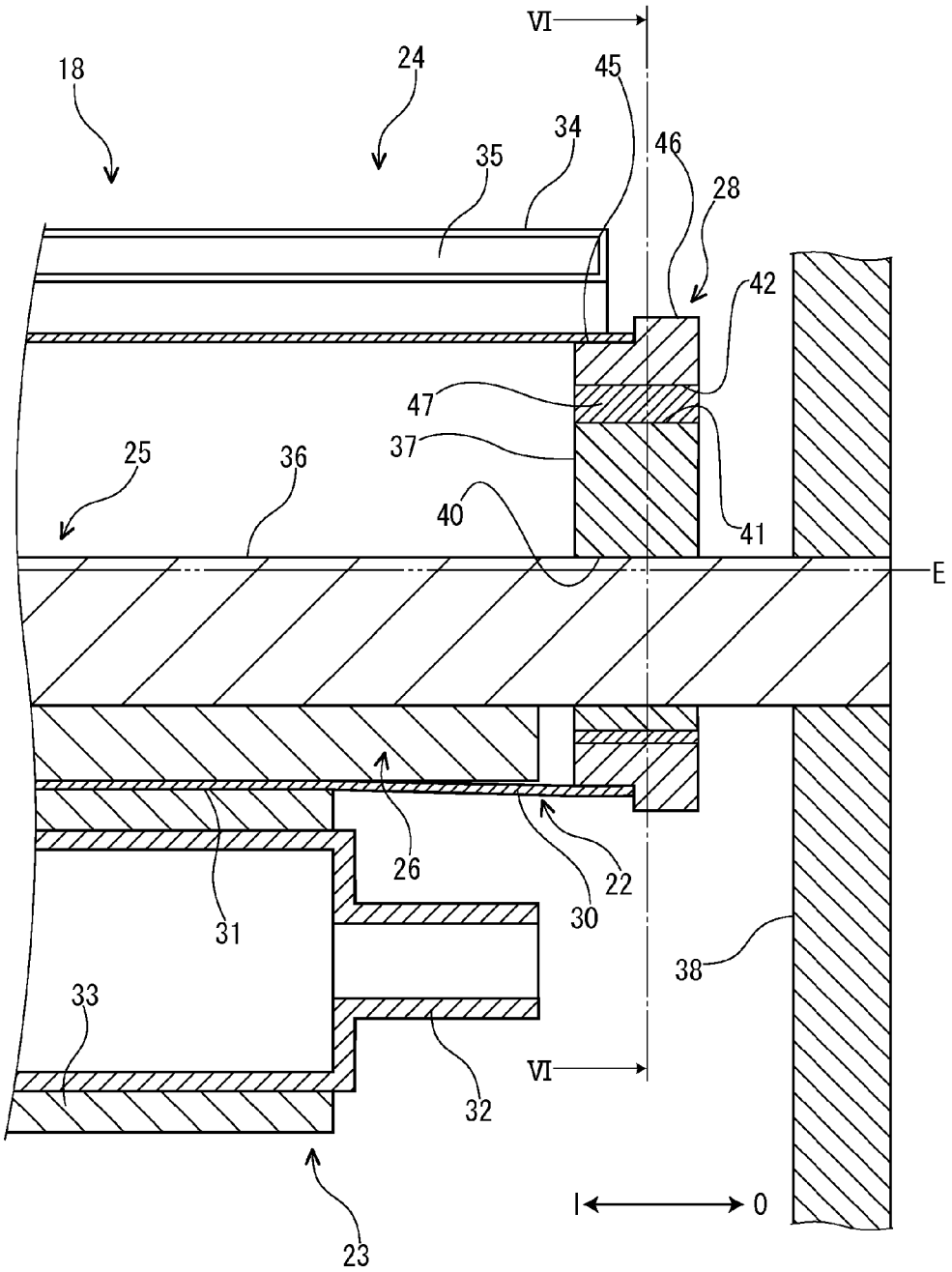
FIG. 5 is a sectional side view showing a fixing device in the printer according to another embodiment of the present disclosure.
Figure 6:
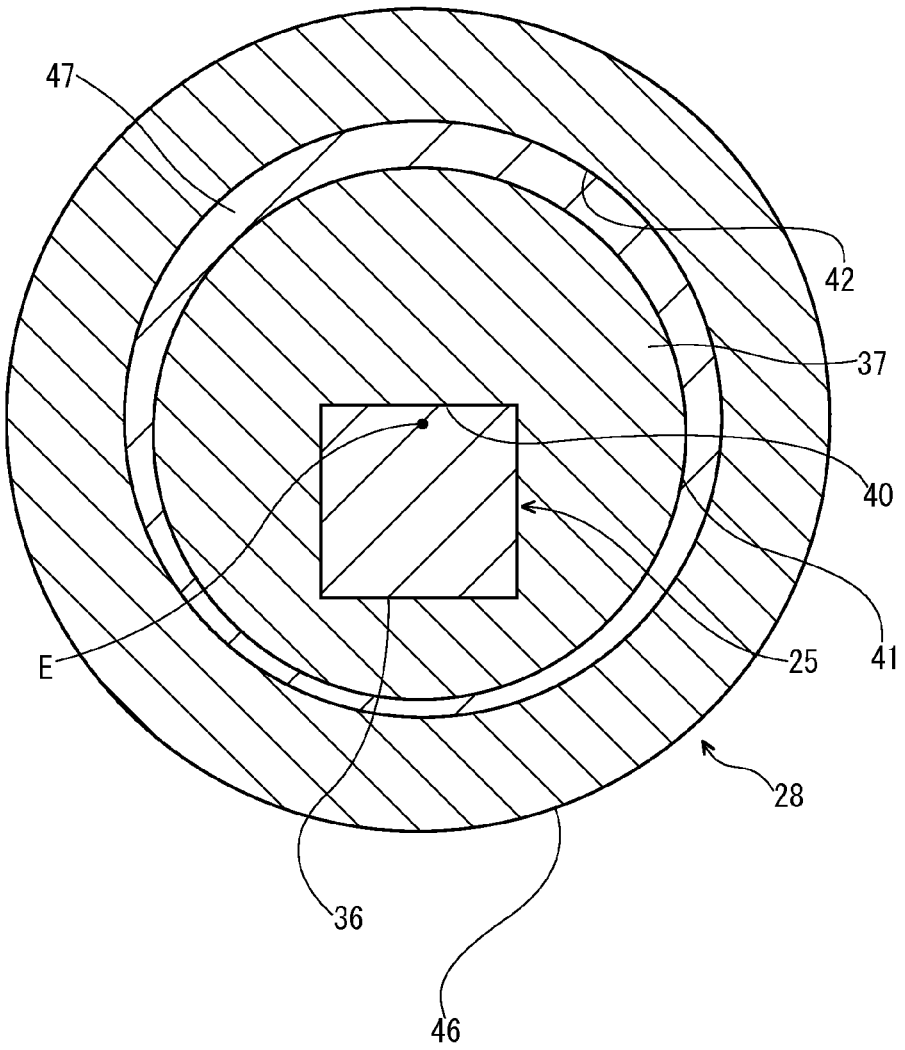
FIG. 6 is a sectional view along the line VI-VI of FIG. 5.

In the embodiment, the gap g is provided between the insertion part 37 of the holding member 25 and each end cap 28. On the other hand, in another embodiment, as shown in FIG. 5 and FIG. 6, an elastic member 47 which is weaker in rigidity than the fixing belt 22 may be interposed between the insertion part 37 of the holding member 25 and each end cap 28. By adopting such configuration, since each end cap 28 is held by the holding member 25 via the elastic member 47, it is possible to stabilize positions of each end cap 28 and the fixing belt 22. Thus, in a case where a pressure contact between the pressuring roller 23 and the fixing belt 22 is released for the sake of jam handling (handling of jammed sheet (s) of paper), drastic movement of the fixing belt 22 can be prevented. The elastic member 47 can be made of a silicone sponge or rubber, for example.

In the embodiment, drive is inputted from a drive source (not shown) to only the pressuring roller 23. On the other hand, in another embodiment, drive may be inputted from the drive source to only the end cap 28 or drive may be inputted from the drive source to both of the pressuring roller 23 and the end cap 28. In a case where drive is inputted to the end cap 28, for example, a gear is provided on an outer circumferential face of the engagingly locking part 46 of the end cap 28, and this gear may be connected to the drive source.

Although in the embodiment, the main body part 36 and the insertion part 37 of the holding member 25 are separately formed, in another embodiment, the main body part 36 and the insertion part 37 of the holding member 25 may be integrally formed. Also, instill another embodiment different therefrom, the holding member 25 may be composed of only the main body part 36.

In the embodiment, the IH coil 35 is used as a heat source. On the other hand, in another embodiment, a heater such as a halogen heater or a ceramics heater may be used as a heat source.

In the embodiment, the configuration of the disclosure is applied to the printer 1. On the other hand, in another embodiment, the configuration of the disclosure may be applied to a copying machine, a facsimile, a multifunction peripheral or the like.

Second Embodiment

Next, a fixing device 51 according to a second embodiment of the present disclosure will be described with reference to FIG. 7 and FIG. 8. An arrow I of FIG. 7 indicates the inside in a forward or backward direction, and an arrow O of FIG. 7 indicates the outside in the forward or backward direction. Since constituent elements other than the holding member 52 are similar to those of the constituent elements of the first embodiment, these constituent elements are designated by the same reference numerals as those of the constituent elements of the first embodiment, and a duplicate description thereof is omitted.

The holding member 52 includes a main body part 53, insertion parts 54 fixed to both side parts in the forward or backward direction of the main body part 53, and deviation-preventing parts 55 fixed to an end part outside in the forward or backward direction of the insertion parts 54.

A configuration of the main body part 53 is similar to a configuration of the main body part 36 of the first embodiment. Thus, a duplicate description thereof is omitted. Also, a configuration of the insertion parts 54 is similar to a configuration of the insertion parts 37 of the first embodiment except that an end part outside in the forward or backward direction of the insertion portion 54 is more protrusive to the outside in the forward or backward direction than an end cap 28. Thus, the constituent elements of the insertion part 54 are designated by the same reference numerals as those of the constituent elements of the insertion part 37 of the first embodiment, and a duplicate description thereof is omitted.

Each deviation-preventing part 55 forms a circular ring shape. At each deviation-preventing part 55, a communication hole 56 is formed along a forward or backward direction. The communication hole 56 engages with an end part outside in a forward or backward direction of an outer circumferential face of the insertion part 54. In this manner, each deviation-preventing part 55 is fixed to the end part outside in the forward or backward direction of each insertion part 54.

The outer circumferential part of each deviation-preventing part 55 is disposed outside in the forward or backward direction of each end cap 28. A circular ring-shaped projection 57 is provided at the outer circumferential part of a face inside in the forward or backward direction of each deviation-preventing part 55.

Figure 7:
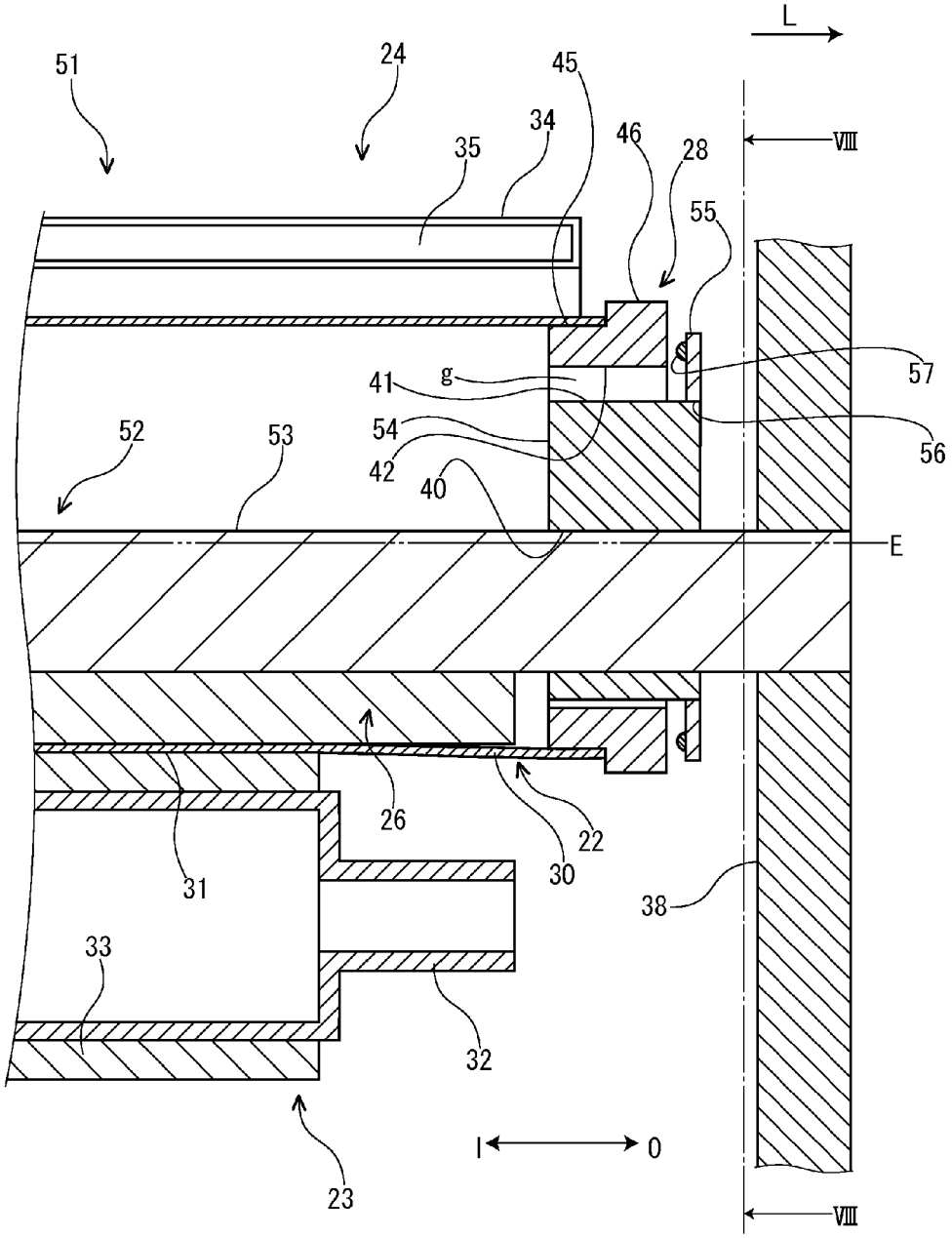
FIG. 7 is a sectional side view showing a fixing device in a printer according to a second embodiment of the present disclosure.
Figure 8:
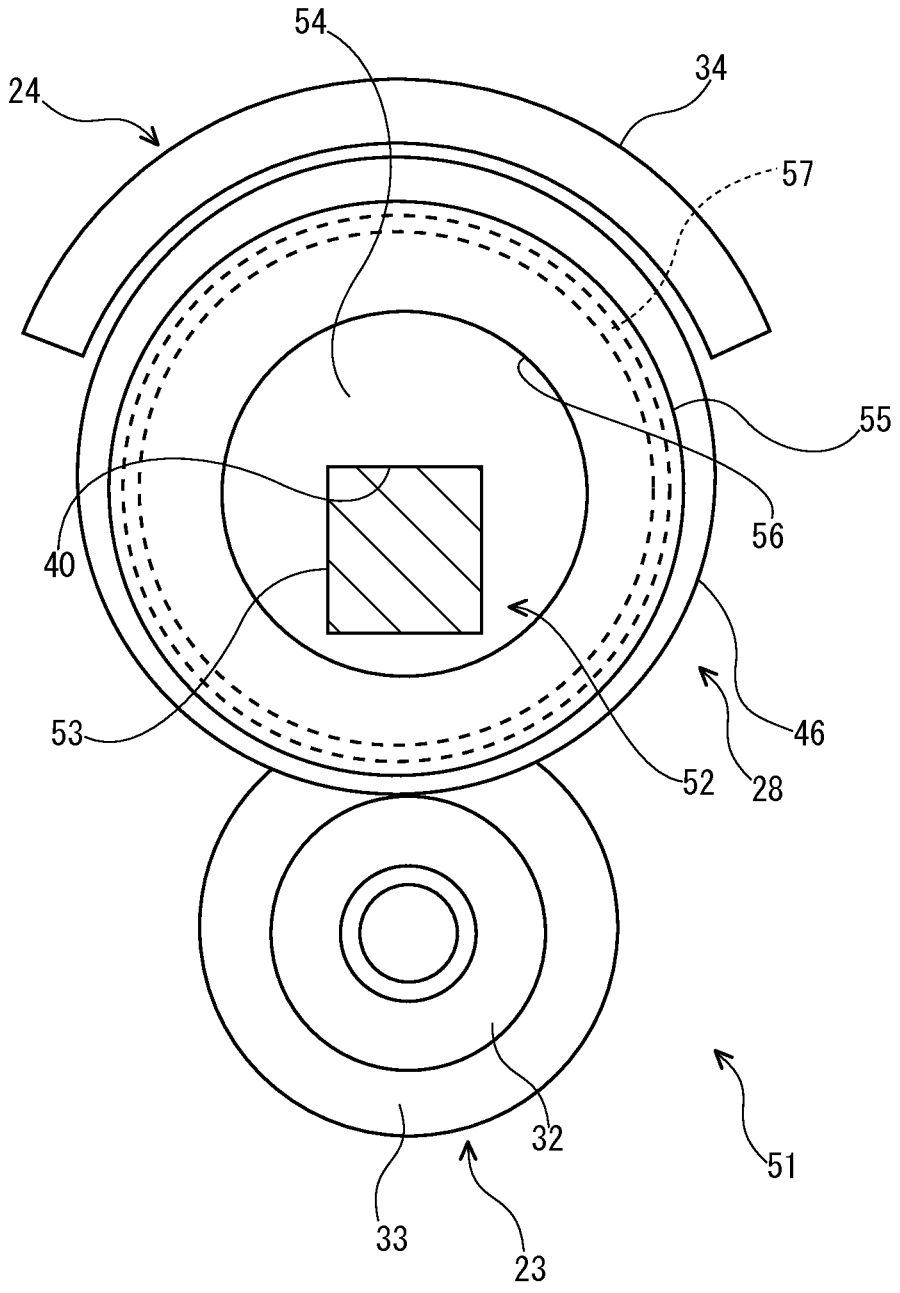
FIG. 8 is a sectional view along the line VIII-VIII of FIG. 7.

In the constituent elements as mentioned above, in a case where the fixing belt 22 rotates, the fixing belt 22 deviates to the outside in the forward or backward direction (refer to an arrow L of FIG. 7). In a case where the fixing belt 22 thus deviates to the outside in the forward or backward direction, the end cap 28 comes into contact with the projection 57 of the deviation-preventing part 55. In this manner, it is possible to reliably prevent the fixing belt 22 from deviating to the outside in the forward or backward direction by a predetermined margin or more.

Third Embodiment

Figure 9:
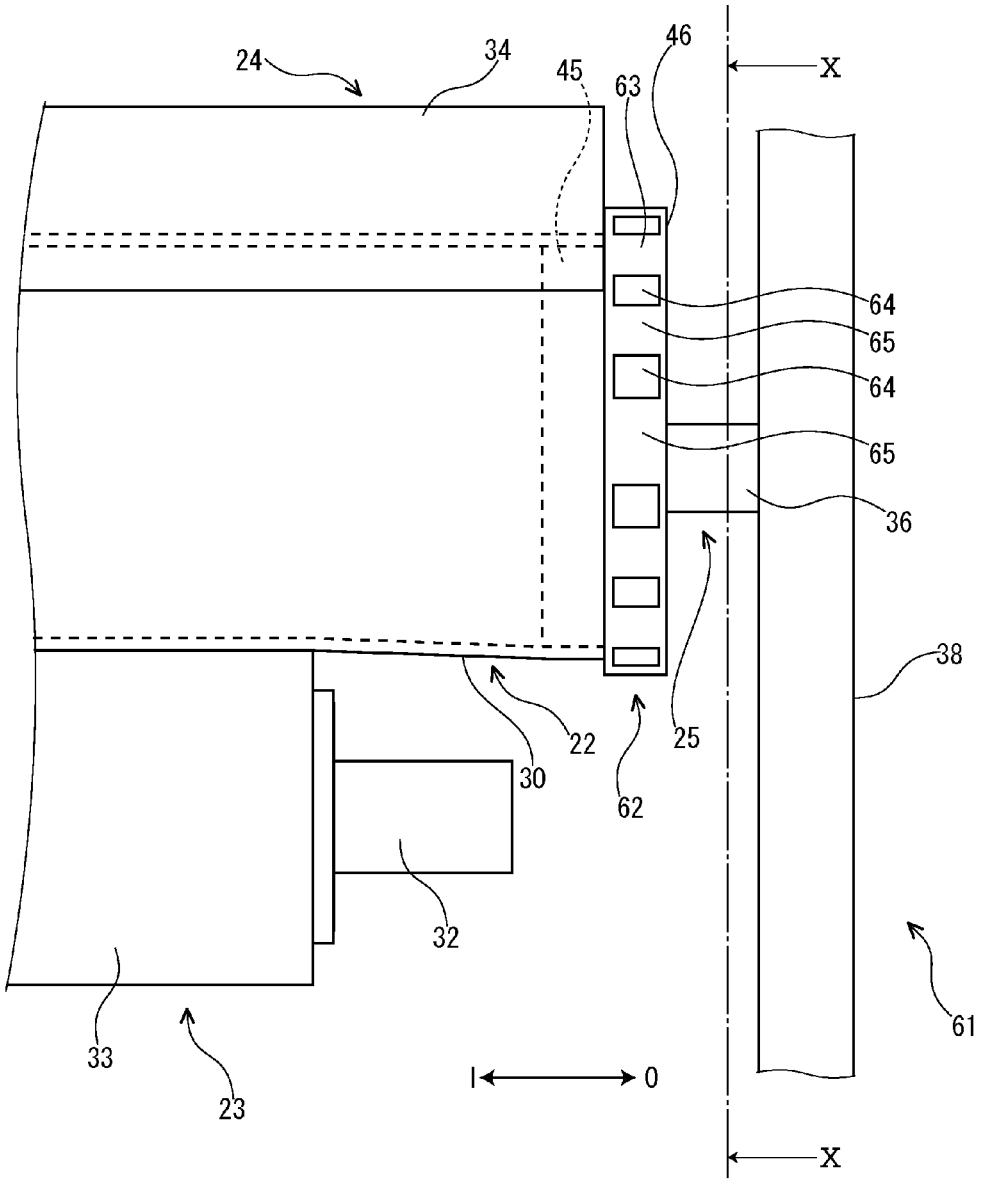
FIG. 9 is a side view showing a fixing device in a printer according to a third embodiment of the present disclosure.
Figure 10:
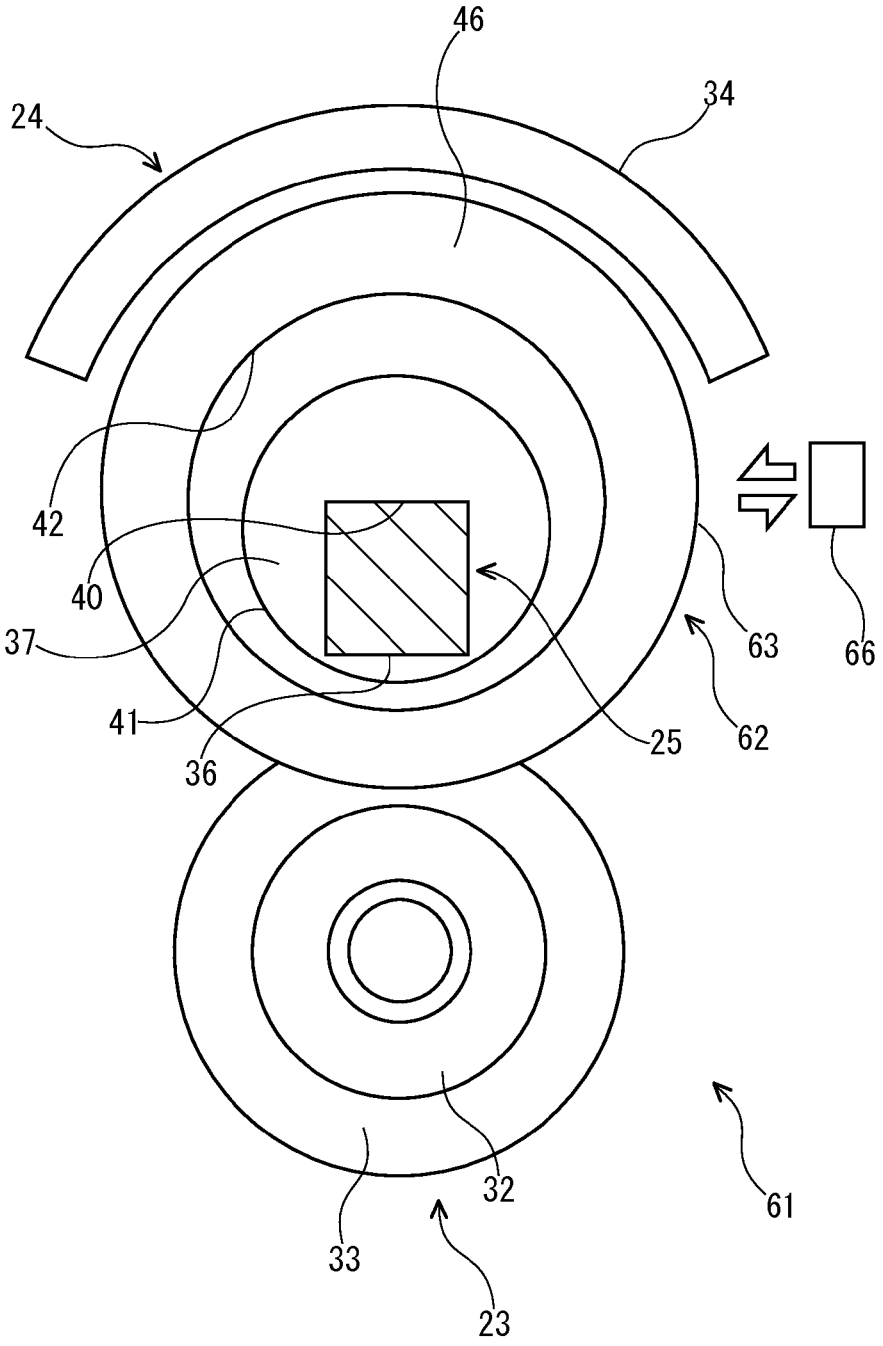
FIG. 10 is a sectional view along the line X-X of FIG. 9.
Figure 11:
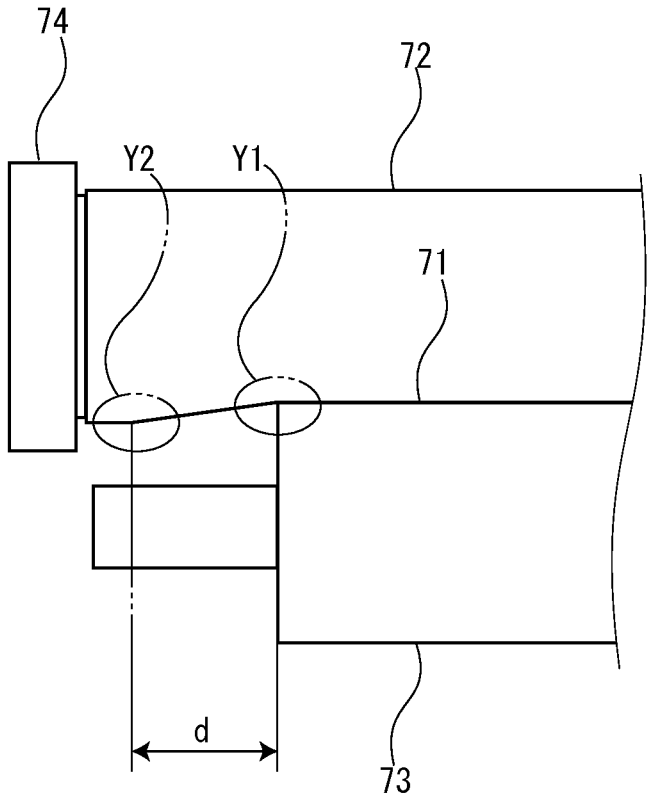
FIG. 11 Related Art
FIG. 11 is a side view showing a fixing device.

Next, a fixing device 61 according to a third embodiment of the present disclosure will be described with reference to FIG. 9 and FIG. 10. An arrow I of FIG. 9 indicates inside in a forward or backward direction, and an arrow O of FIG. 9 indicates outside in the forward or backward direction. Since constituent elements other than the end cap 62 are similar to those of the first embodiment, these constituent elements are designated by the same reference numerals as those of the first embodiment, and a duplicate description thereof is omitted. As to the end cap 62, the similar constituent elements to those of the first embodiment are designated in the figures by the same reference numerals as those of the end cap 28 of the first embodiment, and a duplicate description thereof is omitted.

A detected part 63 is provided on an outer circumferential face of an engagingly locking part 46 of the end cap 62. In the detected part 63, an applied part 64 to which coating is applied and a non-applied part 65 to which no coating is applied, are alternately provided in a circumferential direction.

A sensor 66 is disposed lateral of the engagingly locking part 46 of the end cap 62. The sensor 66 is a reflective PI sensor (Photo Interrupter Sensor), for example. The sensor 66 includes a light emitting part configured to emit light toward the detected part 63 and a light receiving part configured to receive light reflected from the detected part 63.

In the constituent elements as mentioned above, in a state in which the detected part 63 is not rotating, namely in a state in which the fixing belt 22 and the end cap 62 are not rotating, the light emitted from the light emitting part of the sensor 66 continuously hits either the applied part 64 or the non-applied part 65 of the detected part 63. Thus, the light reception amount of the light receiving part of the sensor 66 is kept constant. In this case, it is possible to determine that the fixing belt 22 is not rotating.

On the other hand, in a state in which the detected part 63 is rotating, namely in a state in which the fixing belt 22 and the end cap 62 are rotating, since the light emitted from the light emitting part of the sensor 66 alternately hits the applied part 64 and the non-applied part 65 of the detected part 63, the light reception amount of the light receiving part of the sensor 66 switches. In this case, it is possible to determine that the fixing belt 22 is rotating.

As described above, in the embodiment, rotation of the detected part 63 of the end cap 62 can be detected by the sensor 66. Thus, it is possible to determine whether or not the fixing belt 22 is rotating, based on a result of detection of the sensor 66, and it is possible to avoid a circumstance that the fixing belt 22 is heated by the IH coil 35 in the state in which the fixing belt 22 is not rotating.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a holding member configured to hold the pressing member;

an end cap mounted to an end part in a direction of a rotation axis of the fixing belt and being movable in a radial direction of the fixing belt with respect to the holding member; and an elastic member interposed between the holding member and the end cap.

2. The fixing device according to claim 1, further comprising:

a detected part provided on an outer circumferential face of the end cap; and a sensor configured to detect rotation of the detected part.

3. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a holding member configured to hold the pressing member; and an end cap mounted to an end part in a direction of a rotation axis of the fixing belt and being movable in a radial direction of the fixing belt with respect to the holding member, wherein the end cap includes a through hole formed along the direction of the rotation axis, and the holding member includes:

a main body part extending in the direction of the rotation axis and passing through the through hole; and an insertion part fixed to an outer circumference of the main body part and inserted into the through hole.

4. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a holding member configured to hold the pressing member; and an end cap mounted to an end part in a direction of a rotation axis of the fixing belt and being movable in a radial direction of the fixing belt with respect to the holding member, wherein the holding member includes a deviation-preventing part disposed outside in the direction of the rotation axis of the end cap.

5. The fixing device according to claim 4, wherein a circular projection is provided on a face inside in the direction of the rotation axis of the deviation-preventing part.

6. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a holding member configured to hold the pressing member; and an end cap mounted to an end part in a direction of a rotation axis of the fixing belt and being movable in a radial direction of the fixing belt with respect to the holding member, wherein the end cap includes:

a fixed part fixed to the end part in the direction of the rotation axis of the fixing belt; and an engagingly locking part provided outside in the direction of the rotation axis of the fixed part and configured to engagingly lock the end part in the direction of the rotation axis of the fixing belt.

7. The fixing device according to claim 6, wherein a boundary part between the fixed part and the engagingly locking part forms a stepped shape.

8. An image forming apparatus comprising:

a fixing device configured to include:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a holding member configured to hold the pressing member;

an end cap mounted to an end part in a direction of a rotation axis of the fixing belt and being movable in a radial direction of the fixing belt with respect to the holding member; and an elastic member interposed between the holding member and the end cap.

9. The image forming apparatus according to claim 8, wherein the end cap includes a through hole formed along the direction of the rotation axis, and the holding member includes:

a main body part extending in the direction of the rotation axis and passing through the through hole; and an insertion part fixed to an outer circumference of the main body part and inserted into the through hole.

10. The image forming apparatus according to claim 8, wherein the holding member includes a deviation-preventing part disposed outside in the direction of the rotation axis of the end cap.

11. The image forming apparatus according to claim 10, wherein a circular projection is provided on a face inside in the direction of the rotation axis of the deviation-preventing part.

12. The image forming apparatus according to claim 8, wherein the fixing device further includes:

a detected part provided on an outer circumferential face of the end cap; and a sensor configured to detect rotation of the detected part.

13. The image forming apparatus according to claim 8, wherein the end cap includes:

a fixed part fixed to the end part in the direction of the rotation axis of the fixing belt; and an engagingly locking part provided outside in the direction of the rotation axis of the fixed part and configured to engagingly lock the end part in the direction of the rotation axis of the fixing belt.

14. The image forming apparatus according to claim 13, wherein a boundary part between the fixed part and the engagingly locking part forms a stepped shape.

* * * * *